US010821580B2

(12) United States Patent
Hsieh

(10) Patent No.: US 10,821,580 B2
(45) Date of Patent: Nov. 3, 2020

(54) ELECTRONIC TORQUE WRENCH WITH SENSING STRUCTURE

(71) Applicant: KABO TOOL COMPANY, Taichung (TW)

(72) Inventor: Chih-Ching Hsieh, Taichung (TW)

(73) Assignee: KABO TOOL COMPANY, Taichung (TW)

( * ) Notice: Subject to any disclaimer, the term of this patent is extended or adjusted under 35 U.S.C. 154(b) by 135 days.

(21) Appl. No.: 15/959,163

(22) Filed: Apr. 20, 2018

(65) Prior Publication Data

US 2018/0354109 A1 Dec. 13, 2018

(30) Foreign Application Priority Data

Jun. 12, 2017 (TW) ..... 106119465 A

(51) Int. Cl.
*B25B 23/142* (2006.01)
*B25B 13/46* (2006.01)

(52) U.S. Cl.
CPC ..... *B25B 23/1425* (2013.01); *B25B 13/463* (2013.01)

(58) Field of Classification Search
CPC ..... B25B 23/1427; B25B 23/14; B25B 13/04; B25B 13/06; B25B 23/1425; B25B 23/144; B25B 23/145; B25B 23/147; B25B 23/142; B25B 23/159; G01L 25/003
See application file for complete search history.

(56) References Cited

U.S. PATENT DOCUMENTS 4,982,612 A * 1/1991 Rittmann ..... B25B 23/1425 73/862.23
6,269,717 B1 * 8/2001 Bollinger ..... B25B 13/06 81/124.4
6,928,885 B1 * 8/2005 Shiao ..... B25B 23/1425 73/862.191
7,478,566 B2 * 1/2009 Liao ..... B25B 23/1425 73/862.21
2010/0206141 A1 * 8/2010 Nakata ..... B25B 23/1425 81/479
2011/0185861 A1 * 8/2011 Hu ..... B25B 23/1425 81/467
2012/0119919 A1 * 5/2012 Chen ..... G01L 11/025 340/665

* cited by examiner

*Primary Examiner* — Robert J Scruggs
(74) *Attorney, Agent, or Firm* — Guice Patents PLLC

(57) ABSTRACT

An electronic torque wrench with sensing structure includes a tubular body, a working head and at least one sensing element. The working head includes a head section and a connection section secured in the front end of the tubular body. The head section is positioned at the front end of the tubular body. The sensing element is disposed on an outer circumference of the tubular body. Accordingly, the length of the connection section of the working head is greatly shortened and the internal structure of the tubular body is simplified to lower the material cost and manufacturing cost. In addition, the weight of the torque wrench is reduced and the sensing precision of the sensing element is enhanced, whereby a user can more easily hold the torque wrench and more smoothly use the torque wrench to enhance the whole benefit of the torque wrench.

11 Claims, 5 Drawing Sheets

ELECTRONIC TORQUE WRENCH WITH SENSING STRUCTURE

BACKGROUND OF THE INVENTION

1. Field of the Invention

The present invention relates to an electronic torque wrench, and more particularly to an electronic torque wrench with sensing structure.

2. Description of the Related Art

A torque wrench is used to tighten/untighten a threaded member. By means of detecting the torque value, the tightening extent of the threaded member can be controlled. Especially to a special or important apparatus, the structures of the components of the apparatus necessitate precise tightening extent. Therefore, the torque value of the torque wrench is preset to tighten the precise components in accordance with the necessary mechanical properties of the apparatus so as to meet the security regulation.

The conventional torque wrenches can be substantially classified into two types, that is, electronic torque wrench and mechanical torque wrench. Please refer to FIG. 1. A conventional electronic torque wrench 10 includes a tubular body 11, a working head 13 and a strain gauge 15. The working head 13 is mounted at the front end of the tubular body 11. A flexible bar 14 is connected with the working head 13 and received in the tubular body 11. The strain gauge 15 is mounted on the circumferential wall of the flexible bar 14. In use of the torque wrench 10, the strain gauge 15 can detect the deformation amount of the flexible bar 14 to measure the torque reached by the torque wrench 10 for a user to control the extent to which the torque wrench 10 tightens the threaded member.

However, in the conventional electronic torque wrench 10, the strain gauge 15 is mounted on the flexible bar 14 of the working head 13. Therefore, the body of the flexible bar 14 of the working head 13 must have a considerable length for arranging the strain gauge 15. This not only leads to increase of the material cost and manufacturing cost of the torque wrench, but also leads to increase of weight of the torque wrench. As a result, the burden of a user in use of the torque wrench is increased.

Furthermore, the flexible bar 14 of the working head 13 is mounted in the tubular body 11. Therefore, before the working head 13 is mounted on the tubular body 11, it is necessary to first dispose the strain gauge 15 on the flexible bar 14 of the working head 13 and then the working head 13 can be assembled and mounted. This not only complicates the assembling process, but also leads to increase of the processing cost.

Moreover, the flexible bar 14 of the working head 13 is received in the tubular body 11 so that the diameter of the flexible bar 14 must be smaller than the diameter of the tubular body 11. As a result, the body of the flexible bar 14 is quite slender and thus it is uneasy to assemble and mount the strain gauge 15 on the flexible bar 14. This makes it difficult to assemble and mount the strain gauge 15 and leads to increase of the processing cost. In addition, the internal structure of the torque wrench 10 is more complicated. Accordingly, the conventional electronic torque wrench 10 has many shortcomings and is not optimal.

SUMMARY OF THE INVENTION

It is therefore a primary object of the present invention to provide an electronic torque wrench with sensing structure.

The torque wrench includes at least one sensing element for detecting the torque value of the torque wrench. The sensing element can be more easily assembled and mounted on the torque wrench.

It is a further object of the present invention to provide an electronic torque wrench with sensing structure, the weight of the wrench is reduced.

It is still a further object of the present invention to provide an electronic torque wrench with sensing structure, the manufacturing cost of the wrench is lowered.

It is still a further object of the present invention to provide an electronic torque wrench with sensing structure, in which the measurement precision of the sensing element is enhanced.

To achieve the above and other objects, the electronic torque wrench with sensing structure of the present invention includes:

a tubular body having a passage at front end;

a working head including a head section and a connection section positioned at one end of the head section, the connection section of the working head being securely disposed in the passage of the tubular body; and at least one sensing element disposed on an outer circumference of the tubular body.

Preferably, the tubular body further includes at least one indentation formed on outer circumference of the tubular body. The sensing element is disposed in the indentation.

Preferably, the connection section of the working head extends into the tubular body by such a depth that the connection section does not reach the position of the indentation.

Preferably, a force application section is formed at the rear end of the tubular body. The working head has a working part. A first length is defined between the working part and the sensing element. A second length is defined between the working part and the force application section. The ratio of the first length to the second length ranges from 1:1.4 to 1:3.

Preferably, the working head is formed with a hidden part received in the tubular body and an exposed part exposed to outer side of the tubular body. The ratio of the length of the hidden part to the length of the exposed part ranges from 1:2 to 1:5.

Still to achieve the above and other objects, the electronic torque wrench with sensing structure of the present invention alternatively includes:

a tubular body having a passage at front end;

a working assembly including a working head and a connection member, the rear end of the working head being separably assembled and connected with the front end of the connection member, the rear end of the connection member being securely disposed in the passage of the tubular body; and at least one sensing element disposed on an outer circumference of the tubular body.

Preferably, the tubular body further includes at least one indentation formed on outer circumference of the tubular body. The sensing element is disposed in the indentation.

Preferably, the connection member extends into the tubular body by such a depth that the connection member does not reach the position of the indentation.

Preferably, the working assembly is formed with a hidden part received in the tubular body and an exposed part exposed to outer side of the tubular body. The ratio of the length of the hidden part to the length of the exposed part ranges from 1:2 to 1:5.

Preferably, a force application section is formed at the rear end of the tubular body. The working head has a working part. A first length is defined between the working part and the sensing element. A second length is defined between the working part and the force application section. The ratio of the first length to the second length ranges from 1:1.4 to 1:3.

According to the above arrangement, the sensing element of the torque wrench is mounted on the outer circumference of the tubular body so that it is unnecessary for the connection section of the working head/the body of the connection member of the working assembly to have a relatively long length. In this case, the length of the connection section/the connection member is greatly shortened so that the material cost and the manufacturing cost are lowered and the weight of the torque wrench is reduced. In this case, a user can more easily hold and use the torque wrench without affecting the operation of the torque wrench.

Furthermore, the sensing element of the torque wrench is mounted on the outer side of the torque wrench (on the outer circumference of the tubular body), not inside the torque wrench (the tubular body). Therefore, it is unnecessary to first dispose the sensing element on the working head/working assembly prior to assembling and mounting the working head/working assembly. Accordingly, the assembling process of the torque wrench is simplified. Also, the sensing element is disposed on the outer side of the torque wrench (on the outer circumference of the tubular body) so that the torque wrench can be more easily processed to lower the manufacturing cost of the torque wrench and simplify the internal structure of the torque wrench and enhance the whole benefit of the torque wrench.

In addition, a proper ratio relationship exists between the first length between the working part and the sensing element and the second length between the working part and the force application section so that the sensing element can more precisely detect and measure the torque change of the torque wrench. Accordingly, the torque of the torque wrench can be more precisely detected and measured.

Also, when the working assembly is disposed on the torque wrench, the working head of the working assembly is replaceable. In this case, a user can replace the working head of the torque wrench in accordance with different working sites. Therefore, the user can complete various wrenching and tightening operations without carrying different torque wrenches. Accordingly, the utility and diversity of the torque wrench are enhanced.

The present invention can be best understood through the following description and accompanying drawings, wherein:

DETAILED DESCRIPTION OF THE PREFERRED EMBODIMENTS

Figure 1:
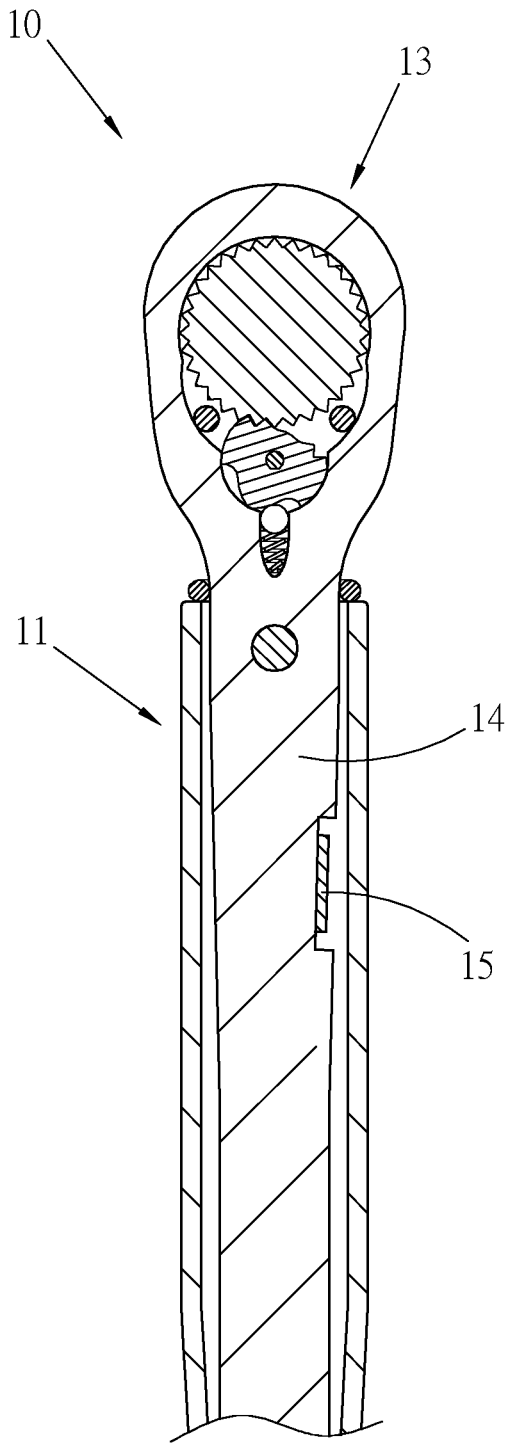
Fig. 1 PRIOR ART
FIG. 1 is a longitudinally sectional view of a conventional torque wrench.
Figure 2:
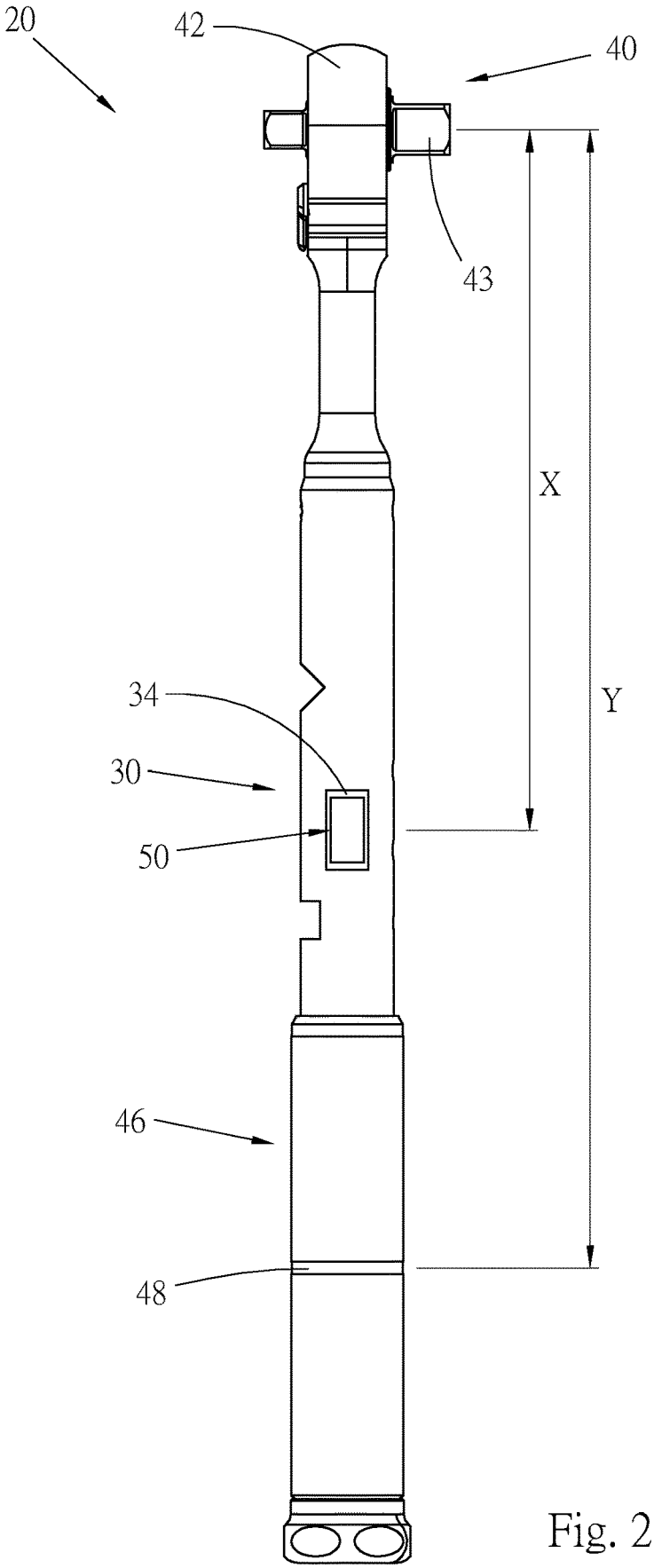
FIG. 2 is a front view of a first preferred embodiment of the torque wrench of the present invention.
Figure 3:
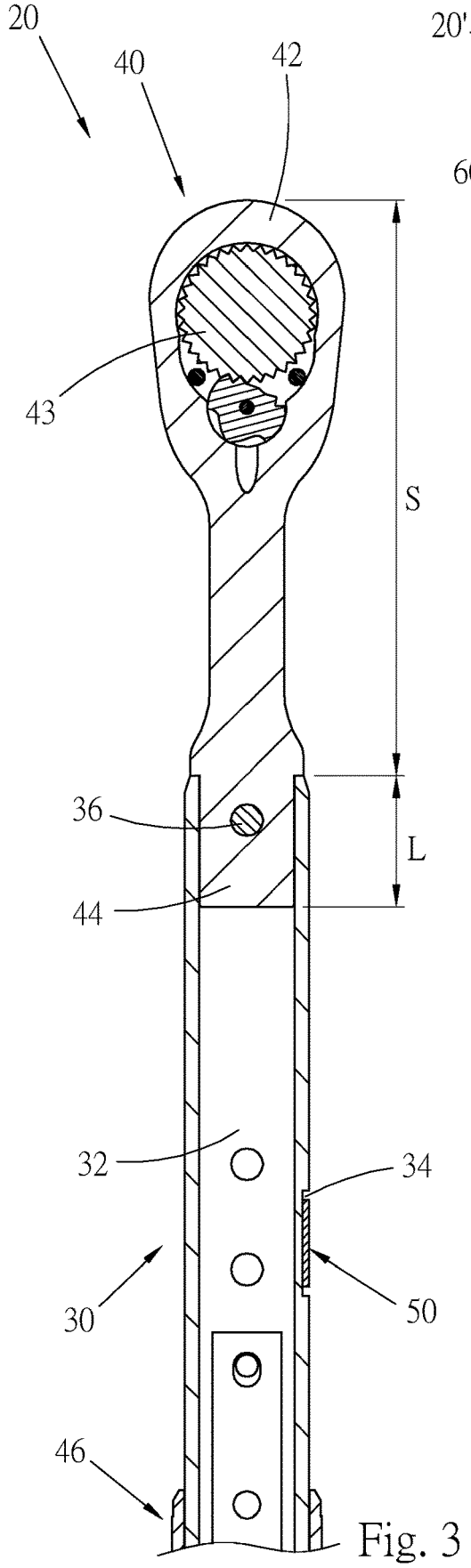
FIG. 3 is a partially enlarged longitudinally sectional view of the first preferred embodiment of the torque wrench of the present invention according to FIG. 2.

Please refer to FIGS. 2 and 3. According to a first preferred embodiment, the electronic torque wrench 20 with sensing structure of the present invention includes a tubular body 30, a working head 40, a handle 46 and at least one sensing element 50.

The tubular body 30 includes a passage 32, at least one indentation 34 and a securing member 36. The passage 32 axially extends through the tubular body 30 between a front end and a rear end of the tubular body 30. An indentation 34 in the embodiment is formed on an outer circumference of the tubular body 30 and closer to the front end of the tubular body 30.

The working head 40 includes a head section 42. One end of the head section 42 is a connection section 44. The head section 42 has a working part 43 where the head section 42 drives a work piece. The working part 43 is such as an insertion column for fitting with a socket to wrench a threaded member (bolt or nut). Alternatively, the working part 43 can be a polygonal fitting hole for fitting with a threaded member. The connection section 44 downward extends from the rear end of the head section 42. In this embodiment, the head section 42 and the connection section 44 are a one-piece member, that is, the head section 42 and the connection section 44 are an integrated structure. The working head 40 is disposed at the front end of the tubular body 30. The connection section 44 of the working head 40 is inserted from the front end of the passage 32 of the tubular body 30 into the passage 32. The connection section 44 extends into the tubular body by such an inserting depth that the connection section 44 does not reach the position of the indentation 34. That is, the indentation 34 is positioned behind the connection section 44 and the rear end of the connection section 44 does not exceed the front end of the indentation 34. The securing member 36 of the tubular body 30 radially passes through the tubular body 30 and the connection section 44 of the working head 40 to assemble and connect the working head 40 and the tubular body 30 with each other. The head section 42 of the working head 40 is positioned at the front end of the tubular body 30. When the working head 40 is mounted on the tubular body 30, a part of the working head 40 is received in the tubular body 30 as a hidden part and another part of the working head 40 is exposed to outer side of the tubular body 30 as an exposed part. The ratio of the length L of the hidden part, that is, the inserting depth of the connection section), to the length S of the exposed part ranges from 1:2 to 1:5, and preferably from 1:2.5 to 1:4.5. In this embodiment, the ratio of the length L of the hidden part to the length S of the exposed part is 1:4.35.

The handle 46 is disposed at the rear end of the tubular body 30. The handle 46 is formed with a force application section 48. The force application section 48 is deemed as a section where the action force applied to the handle 46 is concentrated and serves as a force application point for operating the torque wrench 20.

The sensing element 50 is a torque sensor such as a strain gauge. In this embodiment, one sensing element 50 is mounted for illustration purposes. The sensing element 50 is mounted in the indentation 34 of the tubular body 30 to detect the deformation amount of the tubular body 30 so as to measure the torque of the torque wrench 20. The position of the sensing element 50 is closer to the front end of the tubular body 30 and farther from the rear end of the tubular body 30. It should be noted that in this embodiment, the rear end of the handle 46 is positioned at the rear end of the tubular body 30.

In the design of the present invention, a first length X is defined between the working part 43 of the head section 42 of the working head 40 and the center of the sensing element 50. A second length Y is defined between the working part 43 of the head section 42 and the force application section 48 of the handle 46. The ratio of the first length X to the second length Y ranges from 1:1.4 to 1:3, and preferably from 1:1.5 to 1:2.5. In this embodiment, the ratio of the first length X to the second length Y is 1:1.65.

The subject matter of the present invention is the improvement of the sensing structure of the torque wrench, while the other structures pertain to prior art and thus will not be further described hereinafter.

As shown in FIG. 3, the working head 40 of the present invention is inserted into the tubular body 30 by a short length so that the working head 40 is quite lightweight. This can greatly reduce the weight of the torque wrench 20, whereby when a user operates the torque wrench, the user can more easily and smoothly hold and use the torque wrench 20. When the torque wrench 20 wrenches a threaded member, the tubular body 30 is strained and the sensing element 50 can detect the strain of the tubular body 30. In addition, a proper ratio relationship exists between the first length X between the working part 43 of the working head 40 and the sensing element 50 and the second length Y between the working part 43 of the working head 40 and the force application section 48 of the handle 46 so that the sensing element 50 can more precisely detect and measure the torque change of the working head 40. Accordingly, the torque of the torque wrench 20 can be precisely detected and measured for a user to wrench and tighten the threaded member more precisely.

According to the above arrangement, the sensing element 50 is disposed in the indentation 34 of the outer circumference of the tubular body 30 to shorten the length of the rear end (the connection section 44) of the working head 40. In addition, a proper ratio relationship exists between the length L of the hidden part of the working head 40 and the length S of the exposed part of the working head 40 so as to minify the volume of the working head 40 and reduce the weight of the torque wrench 20. In this case, a user can more lastingly use the torque wrench 20 without feeling tired. Moreover, the operation of the torque wrench 20 will not be affected so that the use of the torque wrench 20 is facilitated.

Moreover, in the present invention, the length of the connection section 44 of the working head 40 is shortened so that the working head 40 can be manufactured with less material. Accordingly, the cost for the material and the manufacturing can be lowered to enhance the economic benefit of the torque wrench 20.

Furthermore, in the present invention, the sensing element 50 is disposed on the outer side of the torque wrench 20 (in the indentation 34 of the tubular body 30), not inside the tubular body 30 of the torque wrench 20. Therefore, the sensing element 50 can be more easily assembled and mounted to simplify the processing and assembling process of the relevant components of the torque wrench 20 and enhance the assembling efficiency. In addition, the internal structure of the torque wrench 20 can be simplified to lower the manufacturing cost of the torque wrench 20. Accordingly, the whole benefit of the torque wrench 20 is enhanced.

In addition, a proper ratio relationship exists between the first length X between the working part 43 of the working head 40 and the sensing element 50 and the second length Y between the working part 43 of the working head 40 and the force application section 48 of the handle 46. Therefore, when the torque wrench 20 wrenches a work piece, the sensing element 50 can more precisely detect and measure the torque change of the working head 40. Accordingly, the currently reached torque of the torque wrench 20 can be precisely detected and measured for a user to wrench and tighten the threaded member more precisely.

Figure 4:
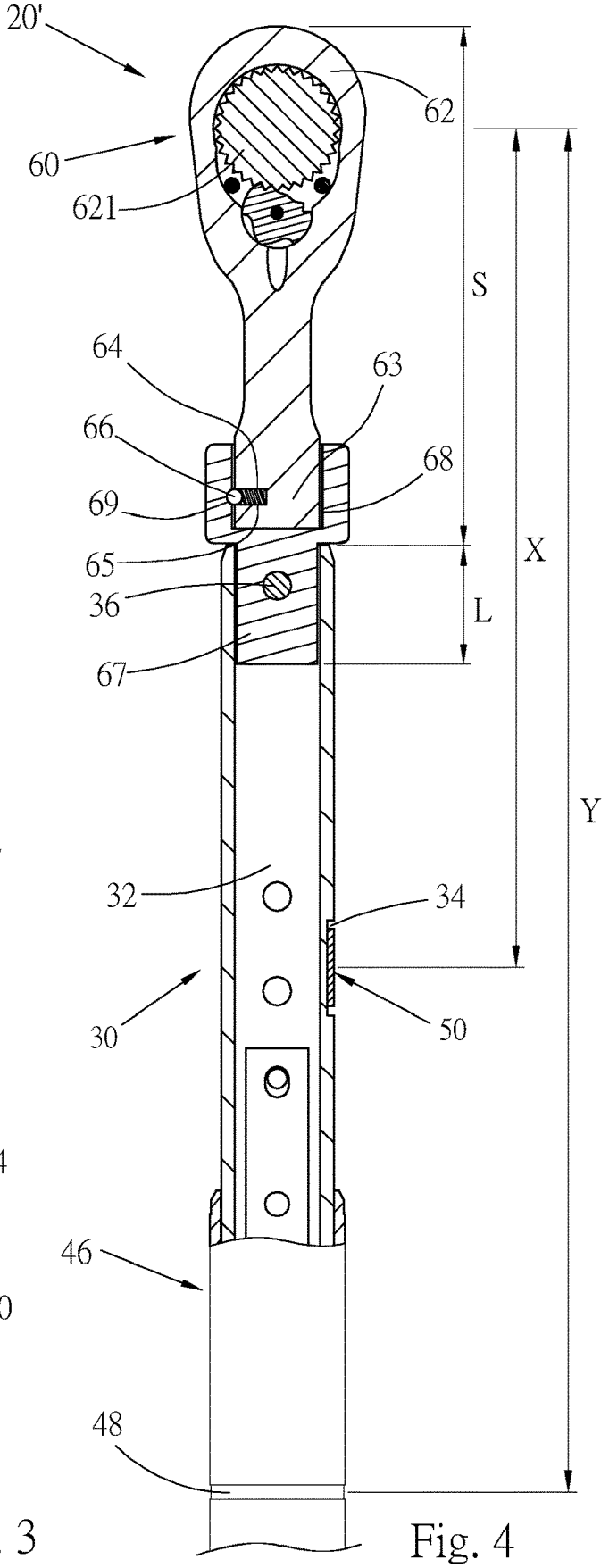
FIG. 4 is a longitudinally sectional view of a second preferred embodiment of the torque wrench of the present invention.

Please now refer to FIG. 4, which shows a second embodiment of the torque wrench 20' of the present invention. The second embodiment of the torque wrench 20' of the present invention also includes a tubular body 30, a handle 46 and a sensing element 50. The same components are denoted with the same reference numerals and will not be redundantly described hereinafter. The second embodiment is different from the first embodiment in that the second embodiment includes a working assembly 60 including a working head 62 and a connection member 67. The body of the working head 62 has a working part 621. The rear end of the working head 62 has a connecting portion. In this embodiment, the connecting portion is a plug column 63. The plug column 63 includes a locating assembly including a receiving socket 64, an elastic member 65 and a locating member 66. The receiving socket 64 is inward recessed from an outer circumference of the plug column 63. In this embodiment, the elastic member 65 is a spring mounted in the receiving socket 64. The locating member 66 is disposed in the receiving socket 64. An outer end of the elastic member 65 serves to elastically push the locating member 66 to protrude from the outer circumference of the plug column 63. The front end of the connection member 67 has a connection part. In this embodiment, the connection part is an insertion socket 68. The insertion socket 68 is formed with a locating hole 69 disposed on an inner circumferential wall of the insertion socket 68. The rear end of the connection member 67 is received in the passage 32 of the front end of the tubular body 30 and secured in the passage 32 by means of the securing member 36. The connection member 67 is mounted in the tubular body 30 by such an inserting depth that the connection member 67 does not reach the position of the indentation 34. The plug column 63 of the working head 62 is separably assembled in the insertion socket 68 of the connection member 67. When the working head 62 is assembled with the connection member 67, the plug column 63 of the working head 62 is plugged in the insertion socket 68 of the connection member 67. At this time, the locating member 66 of the plug column 63 is elastically engaged and located in the locating hole 69 of the insertion socket 68, whereby the working head 62 is affixed to the front end of the connection member 67.

In this embodiment, the working assembly 60 also has a hidden part received in the tubular body 30 and an exposed part exposed to outer side of the tubular body 30. The ratio of the length L of the hidden part to the length S of the exposed part ranges from 1:2 to 1:5, and preferably from 1:2.5 to 1:4.5. In this embodiment, the ratio of the length L of the hidden part to the length S of the exposed part is 1:4.35.

In this embodiment, a first length X is defined between the working part 621 of the working head 62 of the working assembly 60 and the sensing element 50. A second length Y is defined between the working part 621 of the working head 62 of the working assembly 60 and the force application section 48 of the handle 46. The ratio of the first length X to the second length Y ranges from 1:1.4 to 1:3, and preferably from 1:1.5 to 1:2.5. In this embodiment, the ratio of the first length X to the second length Y is 1:1.65.

Figure 5:
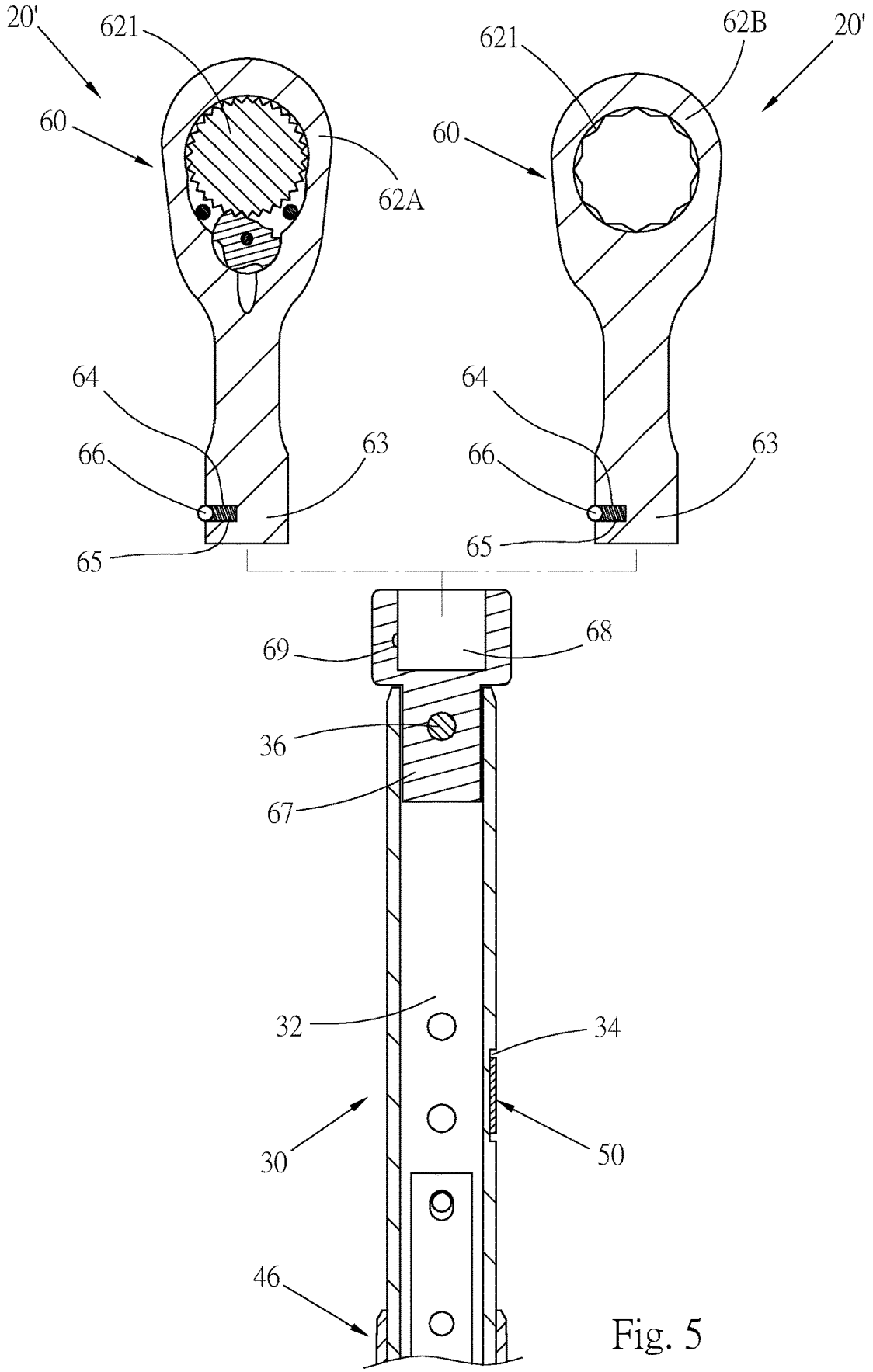
FIG. 5 is a view showing the replacement of the working head of the torque wrench of FIG. 4.

According to the above arrangement, as shown in FIG. 5, the working head 62 of the working assembly 60 is replaceable. The working parts 621 of different forms of working heads 62A, 62B are applicable to different kinds or sizes of sockets or threaded members. For example, after a user uses the working head 62A, the user can release and extract the plug column 63 of the working head 62A out of the insertion socket 68 of the connection member 67 and then plug the plug column 63 of the working head 62B into the insertion socket 68 of the connection member 67 and locate the plug column 63 therein. In this case, a user can use the torque wrench 20' in different working sites to complete different wrenching and tightening operations without carrying various torque wrenches. Accordingly, the utility and diversity of the torque wrench 20' are enhanced.

The second embodiment has the same effect as the first embodiment. The sensing element 50 is disposed in the indentation 34 of the outer circumference of the tubular body 30, not inside the torque wrench. Therefore, the length of the connection member 67 can be greatly shortened to reduce the weight of the wrench and save the material. In addition, the sensing element 50 can be more easily assembled and mounted to simplify the internal structure of the torque wrench and the assembling process of the torque wrench and enhance the production efficiency of the wrench.

Furthermore, a proper ratio relationship exists between the first length between the working part 621 and the sensing element 50 and the second length between the working part 621 and the force application section 48 of the handle 46 so that the sensing element 50 can more precisely detect and measure the torque change of the torque wrench. Accordingly, the precision of the measurement of the torque of the torque wrench is enhanced.

In addition, in this embodiment, the working head 62 of the torque wrench is replaceable so that the utility and diversity of the torque wrench are enhanced.

Figure 6:
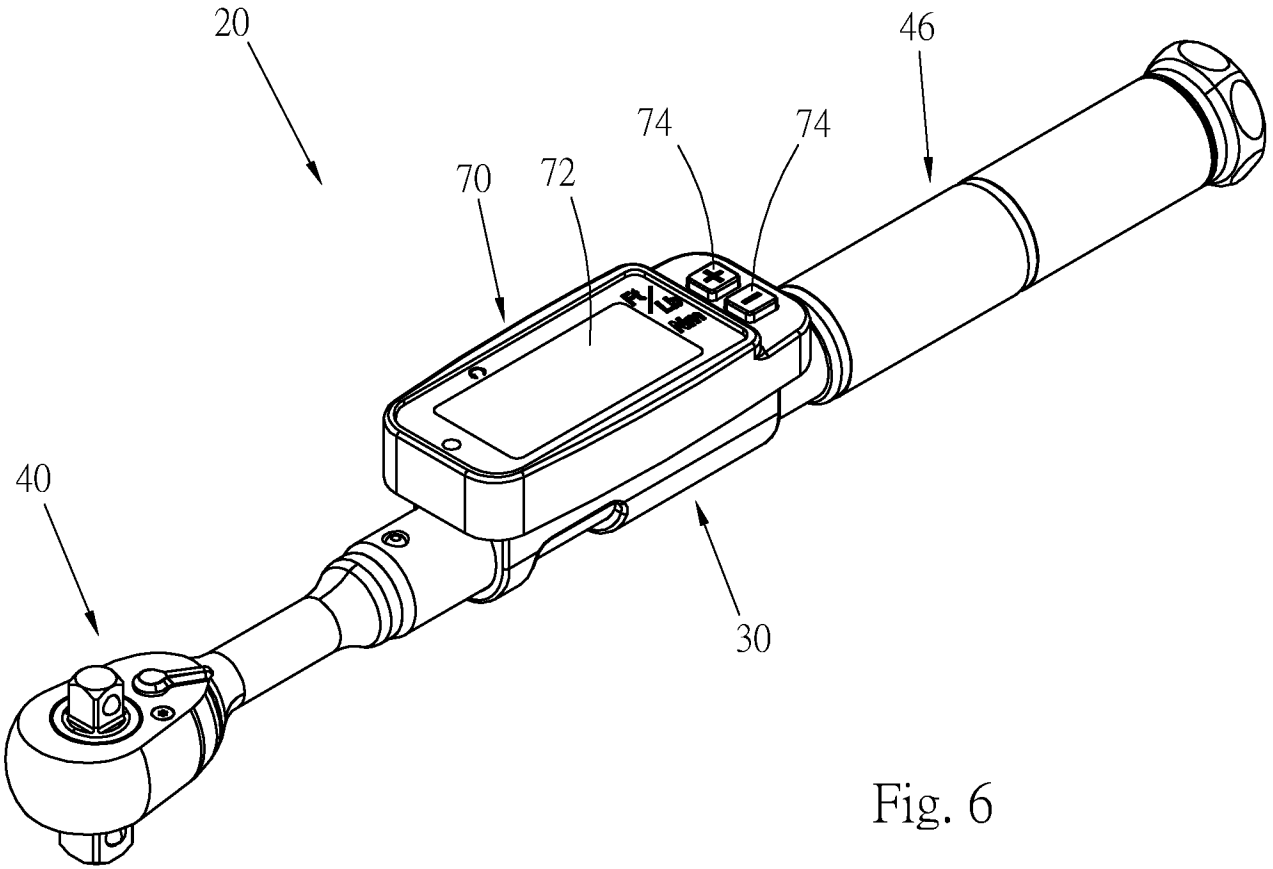
FIG. 6 is a view showing that a display screen and several pushbuttons are disposed on the torque wrench of the present invention.

Please refer to FIG. 6. It should be noted that in practice, a display and control device 70 can be mounted on the tubular body 30 of the torque wrench of the present invention. The display and control device 70 has a display screen 72 and several pushbuttons 74. With the first embodiment of the torque wrench 20 taken as an example, a user can know the torque value of the torque wrench 20 from the display screen 72 and use the pushbuttons 74 to perform relevant operations, for example, setting the torque value. The sensing element can be snugly enclosed in the display and control device 70.

The above embodiments are only used to illustrate the present invention, not intended to limit the scope thereof. Many modifications of the above embodiments can be made without departing from the spirit of the present invention.

What is claimed is:

1. An electronic torque wrench with sensing structure, comprising:

a tubular body including a passage, the passage axially extending through the tubular body between a front end and a rear end of the tubular body;

a working head including a head section and a connection section positioned at one end of the head section, the connection section of the working head being securely disposed in the passage of the tubular body, the head section being positioned at the front end of the tubular body; and at least one sensing element disposed on an outer circumference of the tubular body;

wherein at least one indentation is formed on the outer circumference of the tubular body and the sensing element is disposed in the indentation;

wherein the connection section of the working head extends into the tubular body by such an inserting depth that the connection section does not reach the position of the indentation.

2. The torque wrench as claimed in claim 1, wherein a sensation element is closer to the front end of the tubular body and farther from the rear end of the tubular body.

3. The torque wrench as claimed in claim 2, wherein a force application section is formed at the rear end of the tubular body for driving the torque wrench; the head section of the working head having a working part; a first length being defined between the working part and the sensing element; a second length being defined between the working part and the force application section; a ratio of the first length to the second length ranging from 1:1.4 to 1:3.

4. The torque wrench as claimed in claim 1, wherein a force application section is formed at the rear end of the tubular body for driving the torque wrench; the head section of the working head having a working part; a first length being defined between the working part and the sensing element; a second length being defined between the working part and the force application section; a ratio of the first length to the second length ranging from 1:1.4 to 1:3.

5. The torque wrench as claimed in claim 1, wherein the working head is formed with a hidden part received in the tubular body and an exposed part exposed to outer side of the tubular body, a ratio of the length of the hidden part to the length of the exposed part ranging from 1:2 to 1:5.

6. An electronic torque wrench with sensing structure, comprising:

a tubular body including a passage, the passage axially extending through the tubular body between a front end and a rear end of the tubular body;

a working assembly including a working head and a connection member, a rear end of the working head having a connecting portion, a front end of the connection member having a connection part, the connecting portion of the working head being separably assembled and connected with the connection part of the connection member, the rear end of the connection member being securely disposed in the passage of the tubular body; and at least one sensing element disposed on an outer circumference of the tubular body;

wherein at least one indentation is formed on the outer circumference of the tubular body and the sensing element is disposed in the indentation;

wherein the connection member of the working assembly extends into the tubular body by such an inserting depth that the connection member does not reach the position of the indentation.

7. The torque wrench as claimed in claim 6, wherein the sensing element is closer to the front end of the tubular body and farther from the rear end of the tubular body.

8. The torque wrench as claimed in claim 7, wherein a force application section is formed at the rear end of the tubular body for driving the torque wrench; the working head having a working part; a first length being defined between the working part and the sensing element; a second length being defined between the working part and the force application section; a ratio of the first length to the second length ranging from 1:1.4 to 1:3.

9. The torque wrench as claimed in claim 6, wherein a force application section is formed at the rear end of the tubular body for driving the torque wrench; the working head having a working part; a first length being defined between the working part and the sensing element; a second length being defined between the working part and the force application section; a ratio of the first length to the second length ranging from 1:1.4 to 1:3.

10. The torque wrench as claimed in claim 6, wherein the working assembly is formed with a hidden part received in the tubular body and an exposed part exposed to outer side of the tubular body, a ratio of the length of the hidden part to the length of the exposed part ranging from 1:2 to 1:5.

11. The torque wrench as claimed in claim 6, wherein the connecting portion of the working head of the working assembly is a plug column, the connection part of the connection member being an insertion socket, the plug column of the working head being plugged in the insertion socket of the connection member.

* * * * *